US009065214B2

(12) United States Patent
Nakashima et al.

(10) Patent No.: US 9,065,214 B2
(45) Date of Patent: Jun. 23, 2015

(54) ELECTRICAL CONNECTOR HAVING A GROUND CONTACT WITH A SOLDER PORTION AND A PAIR OF GROUNDING CONTACT PORTIONS

(71) Applicant: Tyco Electronics Japan G.K., Kanagawa (JP)

(72) Inventors: Takeshi Nakashima, Kanagawa (JP); Isao Igarashi, Kanagawa (JP); Izumi Hasegawa, Kanagawa (JP)

(73) Assignee: Tyco Electronics Japan G.K., Kanagawa-ken (JP)

( * ) Notice: Subject to any disclaimer, the term of this patent is extended or adjusted under 35 U.S.C. 154(b) by 16 days.

(21) Appl. No.: 14/081,249

(22) Filed: Nov. 15, 2013

(65) Prior Publication Data

US 2015/0079843 A1 Mar. 19, 2015

(30) Foreign Application Priority Data

Sep. 13, 2013 (JP) ..... 2013190953

(51) Int. Cl.
*H01R 13/648* (2006.01)
*H01R 13/6585* (2011.01)
*H01R 24/00* (2011.01)

(52) U.S. Cl.
CPC ..... *H01R 13/6585* (2013.01); *H01R 23/005* (2013.01)

(58) Field of Classification Search
CPC ..... H01R 23/005; H01R 23/688; H01R 23/7073; H01R 23/725
USPC ..... 439/101, 108, 607.07–607.59
See application file for complete search history.

(56) References Cited

U.S. PATENT DOCUMENTS

| | | | | |
|---|---|---|---|---|
| 6,350,134 | B1 | 2/2002 | Fogg et al. | |
| 6,457,983 | B1 * | 10/2002 | Bassler et al. | 439/101 |
| 6,863,549 | B2 * | 3/2005 | Brunker et al. | 439/108 |
| 6,923,664 | B2 * | 8/2005 | Ito et al. | 439/108 |
| 7,488,188 | B2 * | 2/2009 | Moriyama et al. | 439/108 |
| 7,824,197 | B1 * | 11/2010 | Westman et al. | 439/108 |
| 8,025,532 | B2 | 9/2011 | Nagata et al. | |
| 8,100,720 | B2 * | 1/2012 | Lin et al. | 439/607.34 |
| 2004/0242072 | A1 * | 12/2004 | Kumamoto et al. | 439/608 |

FOREIGN PATENT DOCUMENTS

| | | | |
|---|---|---|---|
| JP | 2010157505 | A | 7/2010 |
| JP | 2010238409 | A | 10/2010 |

* cited by examiner

*Primary Examiner* — Chandrika Prasad
(74) *Attorney, Agent, or Firm* — Barley Snyder

(57) ABSTRACT

An electrical connector including a housing having a mating connector receiving passageway. A pair of first differential signal contacts have solder portions and first contact portions positioned in the mating connector receiving passageway. A first ground contact faces the pair of first differential signal contacts. The first ground contact has a solder portion and a pair of first grounding contact portions spaced apart from each other by a gap and positioned in the mating connector receiving passageway. The pair of first grounding contact portions face the first contact portions of the pair of first differential signal contacts.

13 Claims, 10 Drawing Sheets

ELECTRICAL CONNECTOR HAVING A GROUND CONTACT WITH A SOLDER PORTION AND A PAIR OF GROUNDING CONTACT PORTIONS

CROSS-REFERENCE TO RELATED APPLICATION

This application claims priority under 35 U.S.C. §119(a)-(f) to Japanese Patent Application No. 2013-190953, filed Sep. 13, 2013.

FIELD OF THE INVENTION

The invention generally relates to an electrical connector and, more specifically, to an electrical connector suitable for differential signal transmission.

BACKGROUND

In the fields of electrical communication and digital television requiring ultra-high-speed signal transmission, differential signal transmission is becoming widely used, and consumer demand is for reducing the size of electronic devices used in transmitting high-speed differential signals. For example, Japanese Patent Application No. 2010-157505 discloses a conventional electrical connector for differential signal transmission. In this electrical connector, contact portions responsible for contacting an inserted mating connector are arranged in two rows in a mating connector receiving passageway to reduce the size of the electrical connector's housing. However, solder portions are arranged in one row on a side of the electrical connector to be connected to a circuit board. If the solder portions were arranged in two rows similarly to the contacts in the mating connector receiving passageway, the solder portions arranged outside would constitute an obstacle, making it difficult to perform tasks such as inspections of the soldering state of the solder portions arranged inside the connector, perform repairs of soldering, etc. To prevent this problem, the solder portions are surface-mounted in a single row on the circuit board. The disadvantage of a single row is that the single row requires more space to accommodate than the use of two rows, which is contrary to consumer demand for smaller electronic devices.

One possible solution is to decrease the pitch of the solder portions. However, this approach also presents problems. For example, if the pitch of the solder portions to be connected to the circuit board is set to be equal to or smaller than 0.4 mm, problems such as poor soldering and interference tend to occur. Therefore, decreasing the pitch has a limitation. Thus, if the solder portions are arranged in one row while the arrangement pitch of the solder portions is kept at a predetermined value, the pitch of the contact portions is simply widened even if the solder portions are arranged in two rows in the mating connector receiving passageway. Therefore, decreasing the dimensions of the connectors has a limitation.

The present invention was made in view of the problems described above, and provides a small-sized electrical connector while keeping an arrangement pitch of solder portions to be connected to a circuit board at a predetermined value.

SUMMARY

An electrical connector including a housing having a mating connector receiving passageway. A pair of first differential signal contacts have solder portions and first contact portions positioned in the mating connector receiving passageway. A first ground contact faces the pair of first differential signal contacts. The first ground contact has a solder portion and a pair of first grounding contact portions spaced apart from each other by a gap and positioned in the mating connector receiving passageway. The pair of first grounding contact portions face the first contact portions of the pair of first differential signal contacts.

BRIEF DESCRIPTION OF THE DRAWINGS

The invention will now be described by way of example with reference to the accompanying Figures, of which.

DETAILED DESCRIPTION OF THE EMBODIMENT(S)

The present invention is described below by way of exemplary embodiments with reference to the attached drawings.

Figure 1:
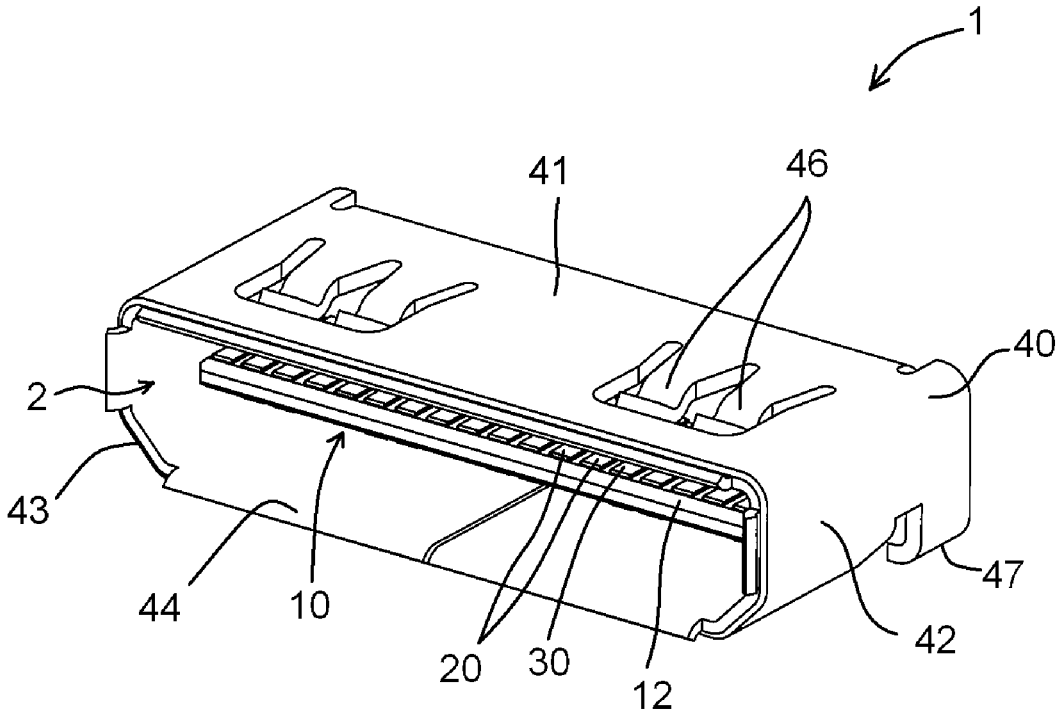
FIG. 1 is a perspective view of an electrical connector according to an embodiment of the present invention viewed from a front side.

FIG. 1 illustrates an exemplary embodiment of an electrical connector 1 mountable to a circuit board (not shown), and including a body 10, a plurality of signal contacts 20, a plurality of ground contacts 30, and a housing 40. The electrical connector 1 has a mating connector receiving passageway 2 defined by the housing 40 and opening to the front (forward). The mating connector receiving passageway 2 is a region for receiving therein and mating with a mating connector (not shown).

The body 10 is formed by molding an appropriate resin such as a Liquid Crystal Polymer ("LCP"), and includes a tongue 12 projecting into the mating connector receiving passageway 2. The body 10 also serves as a support for the contacts 20 and 30 The body 10 has an upper first surface covered an upper first wall 41 of the housing 40, side surfaces covered by a first side wall 42 and a second side wall 43 of the housing 40, a lower second surface covered by a lower second wall 44 of the housing 40, and a terminal end surface covered by a terminal end wall 45 of the housing 40. In an exemplary embodiment, the housing 40 is integrally formed by stamping and bending a conductive metal plate.

On the upper first wall 41 of the housing 40, four latches 46 are formed to make contact with a housing (not shown) of a corresponding mating connector (not shown). A solder foot 47 extends from a terminal end portion of both the first and second side walls 42 and 43, and projects below lower second wall 44. In an exemplary embodiment, the solder feet 47 are soldered to the printed circuit board (not shown).

Figure 2:
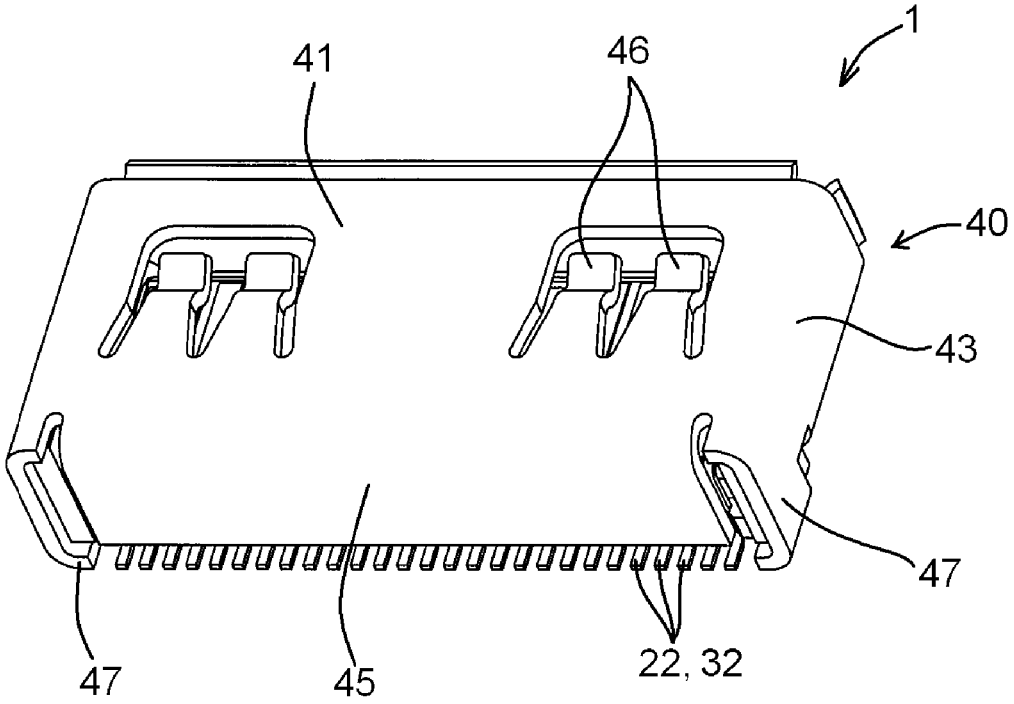
FIG. 2 is a perspective view of the electrical connector of FIG. 1 viewed from a rear side.

FIG. 2 depicts the state in which solder portions 22 and 32 of the contacts 20 and 30, which will be described further below, are exposed from the bottom of the terminal end wall 45 of the housing 40.

Figure 3:
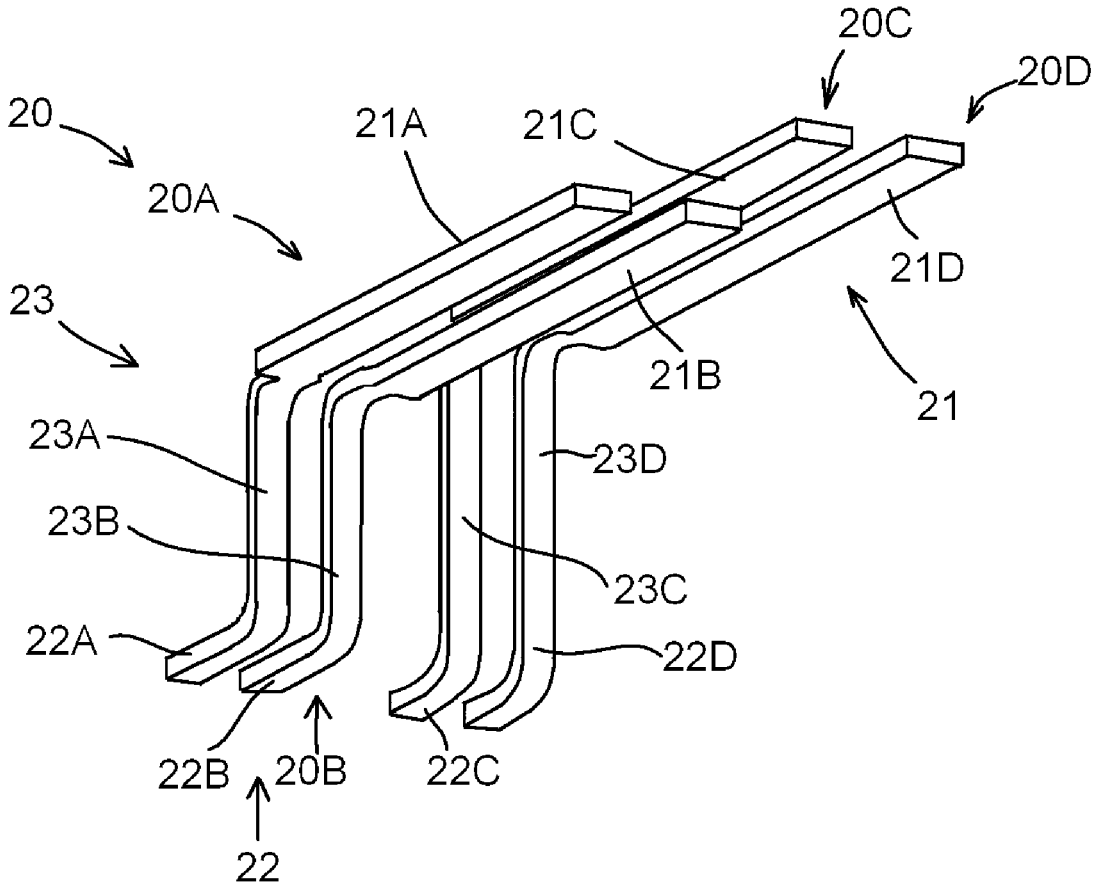
FIG. 3 is a perspective view of signal contacts of the electrical connector of FIG. 1.
Figure 4:
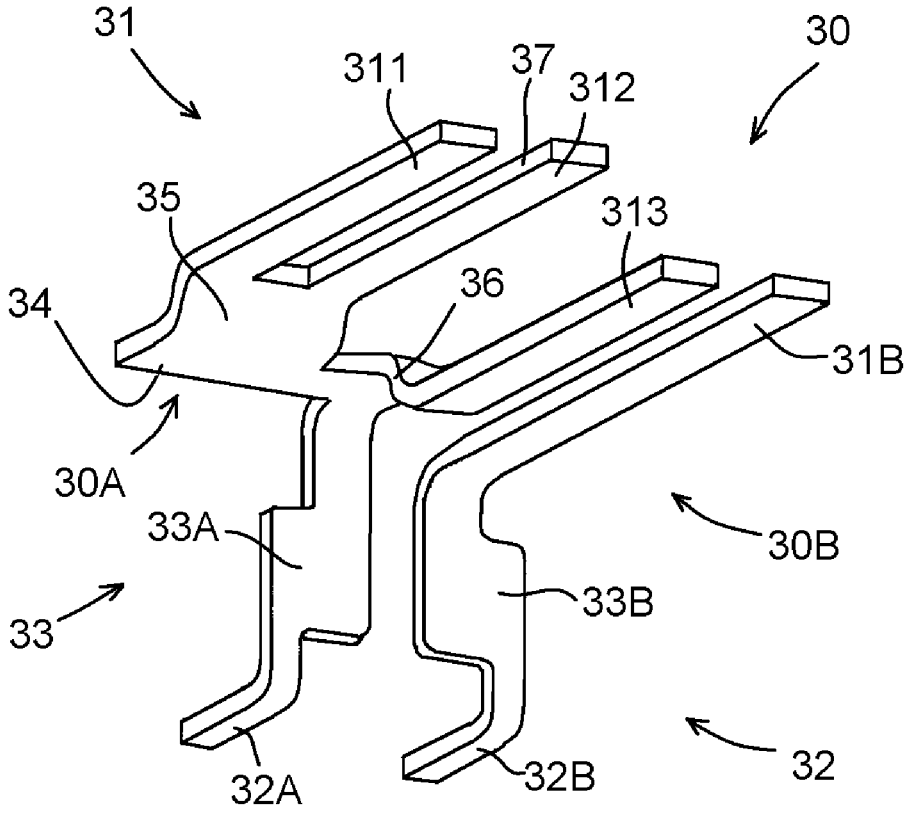
FIG. 4 is a perspective view of ground contacts of the electrical connector of FIG. 1.
Figure 5:
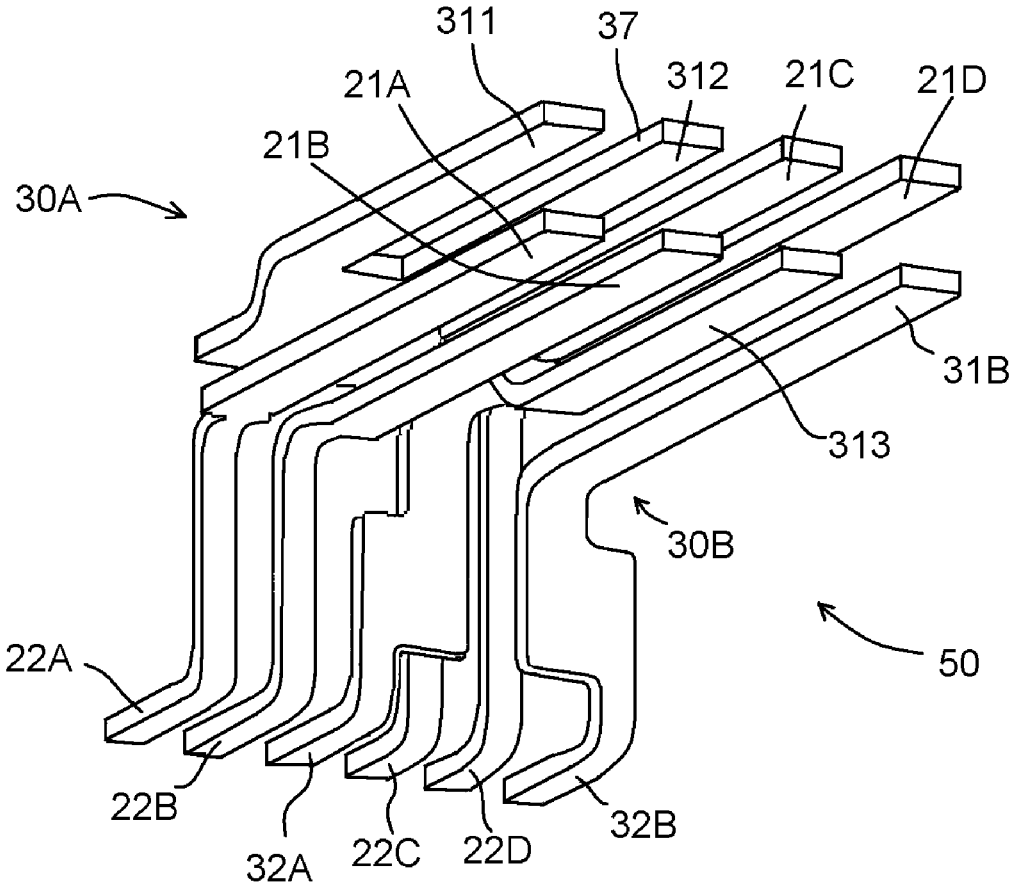
FIG. 5 is a perspective view of a combination of the signal contacts of FIG. 3 and the ground contacts of FIG. 4.
Figure 6:
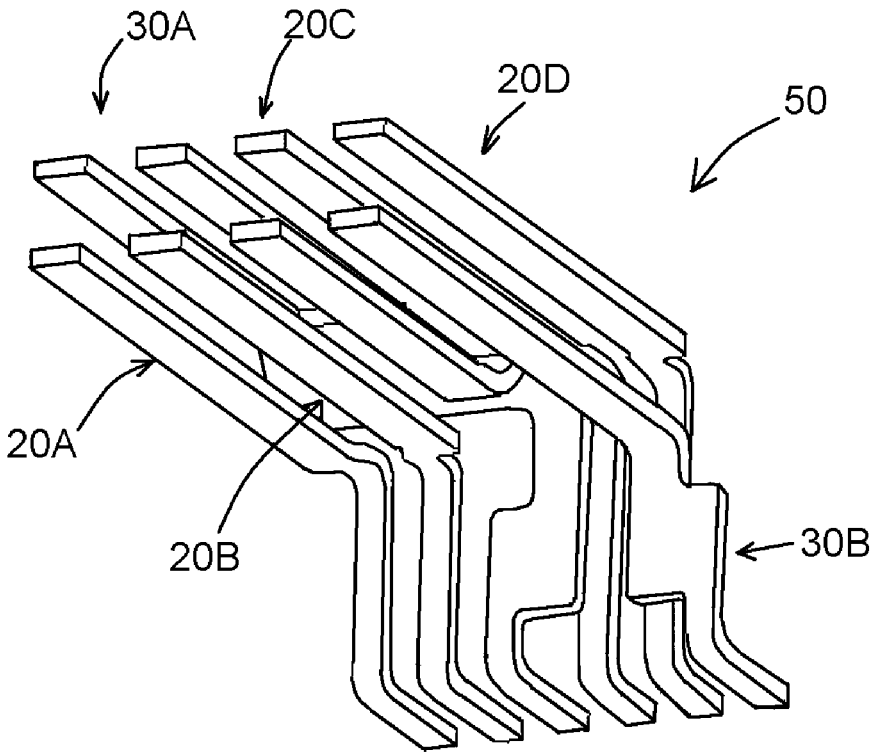
FIG. 6 is a perspective view of the combination of the signal contacts of FIG. 3 and the ground contacts of FIG. 4 viewed from another direction.
Figure 7:
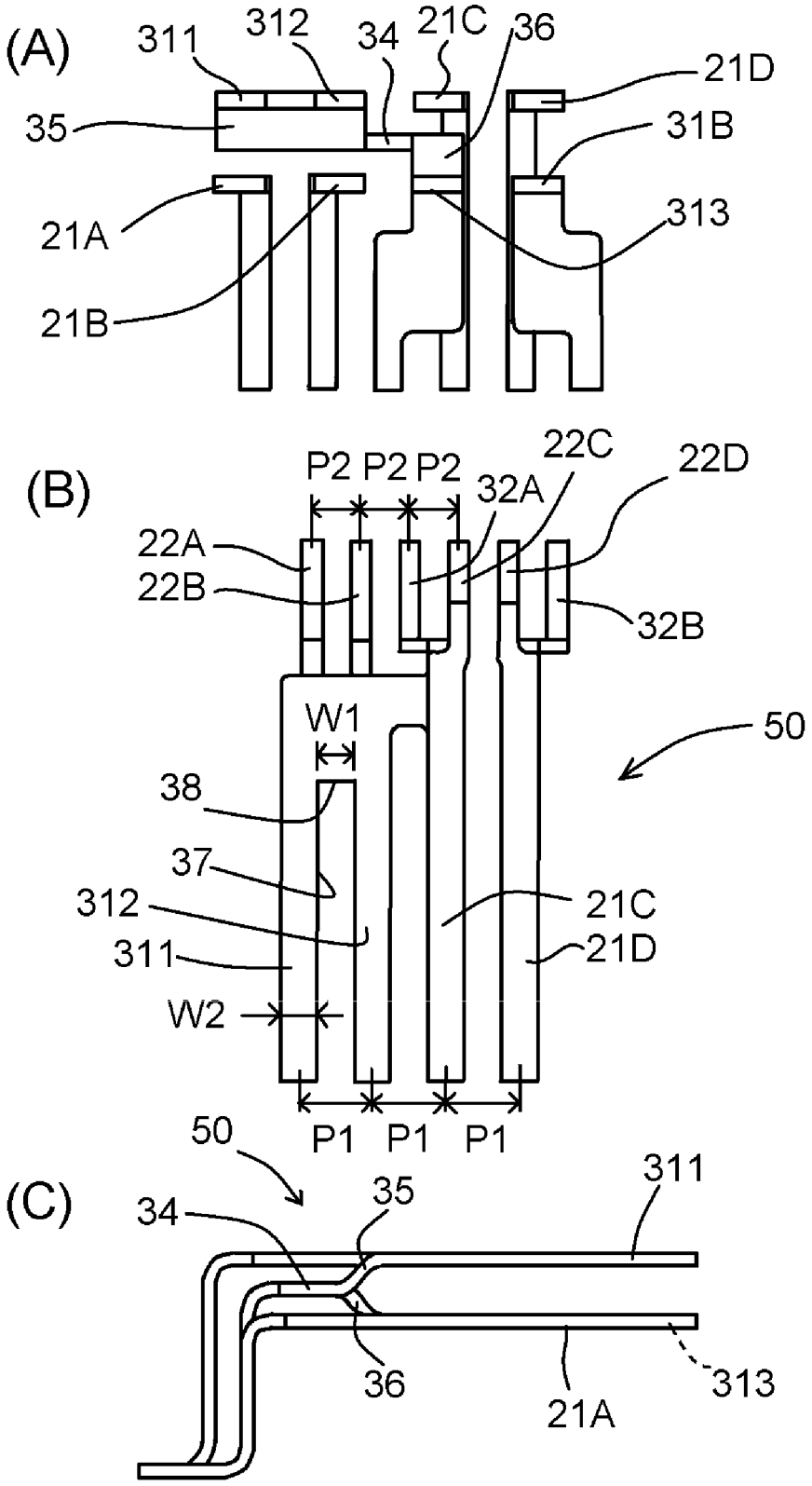
FIG. 7A is a front view of the combination of the signal contacts of FIG. 3 and the ground contacts of FIG. 4.
FIG. 7B is a plan view of the combination of the signal contacts of FIG. 3 and the ground contacts of FIG. 4.
FIG. 7C is a left side view of the combination of the signal contacts of FIG. 3 and the ground contacts of FIG. 4.
Figure 8:
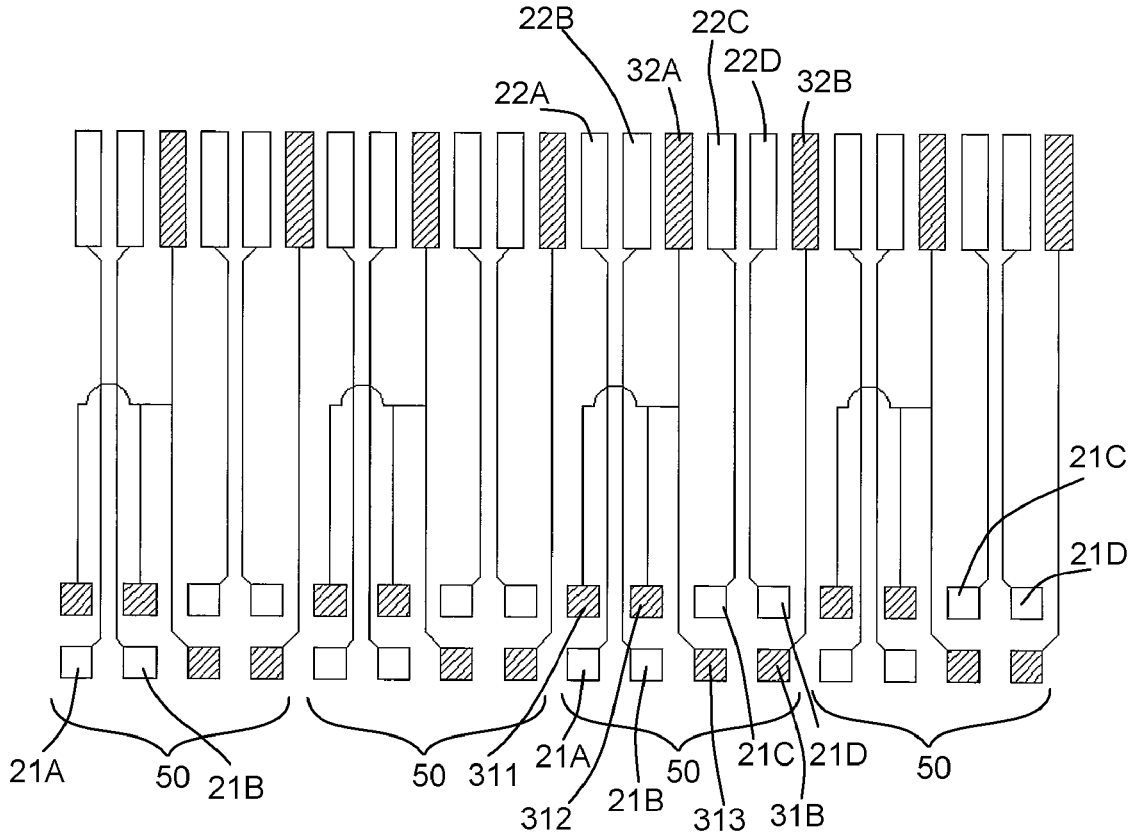
FIG. 8 is a schematic view of the combination of the signal contacts of FIG. 3 and the ground contacts of FIG. 4.

Next, the contacts 20 and 30 are described with reference to FIG. 3 to FIG. 8. FIG. 3 is a perspective view of the signal contacts 20 of FIG. 1. FIG. 4 is a perspective view of the ground contacts 30 of FIG. 1. FIG. 5 is a perspective view of a combination of the signal contacts 20 of FIG. 3 and the ground contacts 30 of FIG. 4. FIG. 6 is a perspective view of the combination of the signal contacts 20 of FIG. 3 and the ground contacts 30 of FIG. 4 viewed from another direction. FIG. 7A is a front view of the combination of the signal contacts 20 of FIG. 3 and the ground contacts 30 of FIG. 4. FIG. 7B is a plan view of the combination of the signal contacts 20 of FIG. 3 and the ground contacts 30 of FIG. 4. FIG. 7C is a left side view of the combination of the signal contacts 20 of FIG. 3 and the ground contacts 30 of FIG. 4. FIG. 8 is a schematic view of the combination of the signal contacts 20 of FIG. 3 and the ground contacts 30 of FIG. 4.

With reference to FIG. 3, the signal contacts 20 include a plurality of pairs of signal contacts 20A, 20B, and 20C, 20D for differential signal transmission. Each signal contact 20 (20A, 20B, 20C, 20D) is formed by stamping and bending a conductive metal plate, and has a contact portion 21, a solder portion 22 to be surface-mounted on the printed circuit board, and a coupling portion 23 for coupling the contact portion 21 and the solder portion 22 together. The length of the coupling portion 23 is different for the paired signal contacts 20A and 20B than the length of coupling portion 23 of the paired signal contacts 20C and 20D. The difference in length results in different heights between the contact portions 21 and the solder portions 22 for the paired signal contacts 20A and 20B as compared to the paired signal contacts 20C and 20D.

The contact portions 21 (21A, 21B, 21C, 21D) make contact with corresponding signal contacts (not shown) of the mating connector. In an exemplary embodiment, the contact portions 21 are a rectangular and tabular shape extending parallel to a main surface of the printed circuit board where the electrical connector 1 is to be mounted. In an exemplary embodiment, the contact portions 21A and 21B of the signal contacts 20A and 20B are closer to the lower surface of the body 10 than the contact portions 21C and 21D of the signal contacts 20C and 20D because the coupling portions 23A and 23B of the signal contacts 20A and 20B are shorter in length than the length of the coupling portions 23C and 23D of the signal contacts 20C and 20D. Therefore the contact portions 21A and 21B are positioned on a lower surface of the tongue 12, and the contact portions 21C and 21D are positioned on an upper surface of the tongue 12. (See FIG. 1) That is, while the contact portions 21A and 21B are positioned in a first row on the lower surface of the tongue 12, the contact portions 21C and 21D are positioned in a second row on the upper surface of the tongue 12. A terminal end region of the contact portions 21A, 21B, 21C and 21D is connected to a terminal end wall (not shown) of the body 10 by press fitting. In an exemplary embodiment, the contact portions 21A, 21B, 21C and 21D have the same width. In another exemplary embodiment, the contact portions 21A, 21B, 21C and 21D have the different widths.

The solder portions 22 (22A, 22B, 22C, 22D) extend parallel to the main surface of the circuit board and are soldered onto the main surface of the circuit board where the electrical connector 1 is to be mounted.

The coupling portions 23 (23A, 23B, 23C, 23D) linearly extends from the terminal end region of the contact portion 21 to a mating end region of the solder portion 22, and along the terminal end wall of the body 10 to couple a rear end of the contact portion 21 and a front end of the solder portion 22.

FIG. 4 illustrates the ground contacts 30, which include a first ground contact 30A and a second ground contact 30B. In an exemplary embodiment, each of the ground contacts 30 (30A, 30B) is formed by stamping and bending a conductive metal plate. Each of the ground contacts 30 have a contact portion 31, a solder portion 32, and a coupling portion 33 (33A, 33B). Specifically, the first ground contact 30A includes the contact portions 311, 312, 313, the solder portion 32A, the coupling portion 33A and a base portion 34. The second ground contact 30B includes the contact portion 31B, the solder portion 32B, and the coupling portion 33B. While the coupling portion 33B of the second ground contact 30B couples the contact portion 31B and the solder portion 32B together, the coupling portion 33A of the first ground contact 30A couples a base portion 34 positioned between the contact portions 311, 312, 313 and the solder portion 32A together. The base portion 34 is connected to a terminal end region of the contact portions 311, 312, and 313.

In an exemplary embodiment, the contact portions 31 (311, 312, 313, 31B) are a rectangular and tabular shape, and extend parallel to the main surface of the circuit board where the electrical connector 1 is to be mounted. While two contact portions 311 and 312 are positioned on the upper surface of the tongue 12, the third contact portion 313 and the contact portion 31B are positioned on the lower surface of the tongue 12. That is, while the contact portions 311 and 312 are positioned in the second row on the upper surface of the tongue 12, the contact portions 313 and 31B are positioned in the first row on the lower surface of the tongue 12. A terminal end region of the contact portions 311, 312, 313 and 31B is connected to a terminal end wall (not shown) of the body by press fitting. (See FIGS. 5 and 6)

The contact portions 311 and 312 are spaced apart from each other with a gap 37 having a width W1 (refer to FIG. 7B). The gap 37 extends from the mating end of the contact portions 311 and 312 to a terminal end of the body 10 which defines the mating connector receiving passageway 2 (refer to FIG. 1). That is, a terminal end tip 38 of the gap 37 is at a position flush with the terminal end wall of the body portion of the body 10. The contact portions 311, 312, 313 and 31B of all of the ground contacts 30A and 30B have the same width W2 as the contact portions 21 (21A, 21B, 21C, 21D) of the signal contacts 20 and face these contact portions 21 with the distance between them being determined by the thickness of the tongue 12 on which they are disposed.

As with the solder portions 22 of the signal contacts 20, the solder portions 32 (32A, 32B) extend approximately in parallel to the main surface of the circuit board so as to be soldered onto the main surface of the circuit board where the electrical connector 1 is to be mounted. The coupling portions 33 (33A, 33B) extend approximately along the terminal end wall of the body 10, and each has its intermediate part formed in a crank shape.

With reference to FIG. 4 and FIGS. 7A-7C, the base portion 34 is positioned at an intermediate height between the contact portion 311, 312 and the contact portion 313, and is coupled to the contact portions 311 and 312 via a curved up portion 35 and also to the contact portion 313 via a curved down portion 36.

As illustrated in FIGS. 5-7C, when the contacts 20 and 30 are positioned onto the body 10 (refer to FIG. 1), the contact portions 21A and 21B of the signal contacts 20A and 20B, the contact portion 313 of the ground contact 30A, and the contact portion 31B of the ground contact 30B form the first row disposed on the lower surface of the body 10 in the mating connector receiving passageway 2.

Simultaneously, the contact portions 21C and 21D of the signal contacts 20C and 20D, the contact portions 311 and 312 of the ground contact 30A form the second row disposed on the upper surface of the body 10 in the mating connector receiving passageway 2. Here, the contact portions 311 and 312 of the ground contact 30A face the contact portion 21A of the signal contact 20A and the contact portion 21B of the signal contact 20B, respectively. Also, the contact portions 313 of the ground contact 30A and the contact portion 31B of the ground contact 30B face the contact portion 21C of the signal contact 20C and the contact portion 21D of the signal contact 20D, respectively. As described above, since the contact portion 21 of the signal contact 20 and the contact portion 31 of the ground contact 30 have the same width and face each other with a predetermined distance, favorable impedance matching can be obtained. Also, since contact receiving recesses (not shown) for the contact portions 21 and 31 on the tongue 12 of the body 10 can all be formed in the same dimensions, molding die components for the body 10 can be simplified.

FIG. 8 is a schematic view of the combination of the signal contacts of FIG. 3 and the ground contacts of FIG. 4. As for the contacts 20 and 30, as depicted in FIG. 5 to FIG. 7C, four (two pairs of) signal contacts 20A, 20B, 20C and 20D and the first and second ground contacts 30A and 30B form one group 50. In the electrical connector 1 as a whole, a total of four groups of the contacts 20 and 30 are arranged in two rows in the mating connector receiving passageway 2 and arranged in one row in the solder portion to be connected to the circuit board. As described above, the contact portions 311 and 312 of the ground contact 30A vertically face the contact portion 21A of the signal contact 20A and the contact portion 21B of the signal contact 20B, respectively, and the contact portion 313 of the ground contact 30A and the contact portion 31B of the ground contact 30B vertically face the contact portion 21C of the signal contact 20C and the contact portion 21D of the signal contact 20D. In the mating connector receiving passageway 2, the contact portions 21A, 21B, 21C and 21D of the signal contacts 20 excluding the contact portion 21A (21D) of the signal contact 20A (20D) at an outer end horizontally are adjacent to the contact portions 31 (311, 312, 313, 31B) of the ground contacts 30. Therefore, since the contact portions 21A and 21B (21C, 21D) of the paired differential signal contacts are substantially surrounded by the ground contacts 30 in the mating connector receiving passageway 2, noise from other paired differential signal contacts can be suppressed, thereby achieving favorable signal transmission performance. Furthermore, the solder portions 22A and 22B (22C, 22D) of the paired differential signal contacts 20 are isolated by the solder portions 32A (32B) of the adjacent ground contacts 30 from other paired differential signal contacts. This also contributes to favorable signal transmission performance.

Still further, with the ground contact 30A having three contact portions 311, 312, and 313, the number of the contact portions in the mating connector receiving passageway 2 is decreased from eight to six. In the present embodiment, as depicted in FIG. 7B, while a first pitch P1 of the contact portions is 0.75 mm, a second pitch P2 of the solder portions is 0.5 mm. Therefore, the small-sized electrical connector 1 can be achieved without extremely decreasing the arrangement pitch of the solder portions to be connected to the circuit board. Yet still further, since the ground contact 30B is separated from the ground contact 30A, this contact 30B can be used for purposes other than the ground for electric power transmission or low-speed signal transmission, thereby widening the application range of the electrical connector 1.

Figure 9:
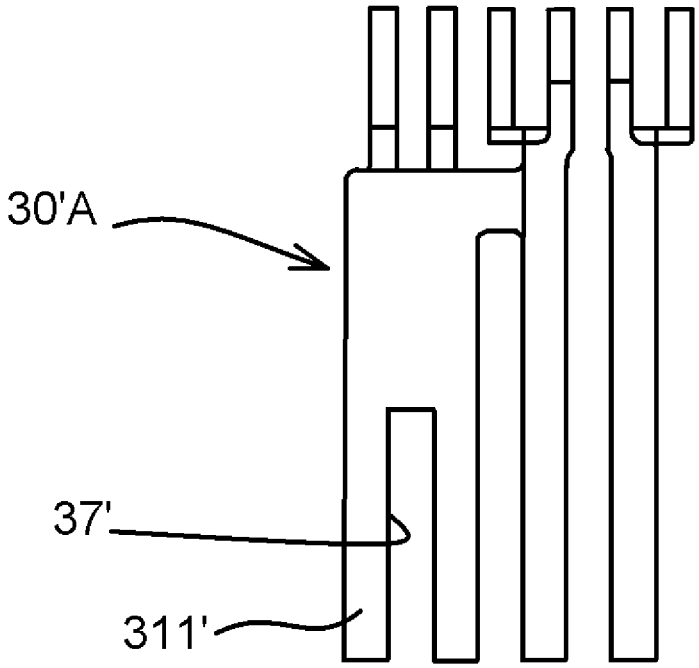
FIG. 9 is a plan view of a first modification example of the combination of the signal contacts and the ground contacts.
Figure 10:
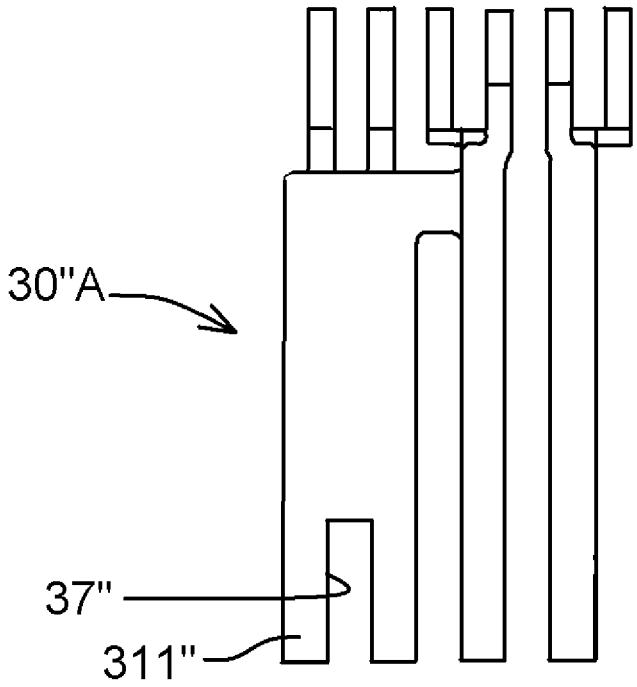
FIG. 10 is a plan view of a second modification example of the combination of the signal contacts and the ground contacts.

FIG. 9 is a plan view of a first modification example of the combination of the signal contacts and the ground contacts. FIG. 10 is a plan view of a second modification example of the combination of the signal contacts and the ground contacts. In these drawings, only the difference from the above-described embodiment is the length of the gap. That is, in a ground contact 30'A depicted in FIG. 9, a gap 37' has a length of approximately two thirds of a length from the tip of a contact portion 311' to the terminal end wall of the body 10. In a ground contact 30"A depicted in FIG. 10, a gap 37" has a length of approximately one third of a length from the tip of a contact portion 311" to the terminal end wall of the body 10. By shortening the length of the gap in this manner, insertion loss in signal transmission can be decreased. Furthermore, the quantity of material needed to form the ground contacts and the amount of plating can be reduced.

While the electrical connectors according to several embodiments have been described in detail above, the present invention is not intended to be restricted to these embodiments, and can be variously modified. For example, while the width of the contact portion 31 of the ground contact 30 is equal to the width of the contact portion 21 of the signal contact 20, the width of the contact portion 31 may be set wider, for example, 1.2 times wider than the width of the contact portion 21. With this configuration, insertion loss in signal transmission can be decreased.

What is claimed is:

1. An electrical connector comprising:

a housing having a mating connector receiving passageway;

a pair of first differential signal contacts, each signal contact having a solder portion;

a first contact portion positioned in the mating connector receiving passageway; and a first ground contact facing the pair of first differential signal contacts and having a solder portion and a pair of first grounding contact portions spaced apart from each other by a gap and positioned in the mating connector receiving passageway and facing the first contact portions of the pair of first differential signal contacts.

2. The electrical connector according to claim 1, wherein:

the first contact portions of the pair of first differential signal contacts are arranged in a first row;

the pair of first grounding contact portions are arranged in a second row; and the ground contact further comprises a third grounding contact portion positioned in the first row adjacent to one of the first differential signal contacts.

3. The electrical connector according to claim 2, further comprising a pair of second differential signal contacts, each having a second contact portion, and one of the second contact portions facing the third grounding contact portion.

4. The electrical connector according to claim 3, further comprising a second ground contact having a solder portion and a second grounding contact portion.

5. The electrical connector according to claim 3, wherein the second contact portion of the other differential signal contact faces the second grounding contact portion.

6. The electrical connector according to claim 5, wherein the solder portion of the second ground contact is positioned between the solder portions of the pair of first differential signal contacts and the solder portions of the pair of second differential signal contacts.

7. The electrical connector according to claim 6, wherein the contact portions of the pair of first differential signal contacts, the third grounding contact portion, and the second grounding contact portion are positioned in the first row, the pair of first grounding contact portions and the second contact portions of the second paired differential signal contacts are placed in the second row, and the solder portions of the pair of second differential signal contacts are positioned between the solder portion of the first ground contact and the solder portion of the second ground contact.

8. The electrical connector according to claim 7, further comprising a plurality of adjacent groups, each group comprising the pair of first differential signal contacts, the first ground contact, the pair of second differential signal contacts, and the second ground contact.

9. The electrical connector according to claim 1, wherein the gap extends from a mating end tip of the first grounding contact portions to a terminal end wall of the housing.

10. The electrical connector according to claim 1, wherein the gap has a length of approximately two thirds of a length from a mating end tip of the first grounding contact portion to a terminal end wall of the housing.

11. The electrical connector according to claim 1, wherein the gap has a length of approximately one third of a length from a mating end tip of the first grounding contact portion to a terminal end wall of the housing.

12. The electrical connector according to claim 1, wherein the width of the first grounding contact portion is equal to the width of the first contact portion.

13. The electrical connector according to claim 1, wherein the width of the first grounding contact portion is greater than the width of the first contact.

* * * * *